US011346144B2

(12) United States Patent
Ko

(10) Patent No.: US 11,346,144 B2
(45) Date of Patent: May 31, 2022

(54) MODULAR GLASS DOOR ASSEMBLY

(71) Applicant: Wen-Shan Ko, Lugang Township, Changhua County (TW)

(72) Inventor: Wen-Shan Ko, Lugang Township, Changhua County (TW)

( * ) Notice: Subject to any disclaimer, the term of this patent is extended or adjusted under 35 U.S.C. 154(b) by 0 days.

(21) Appl. No.: 17/088,866

(22) Filed: Nov. 4, 2020

(65) Prior Publication Data

US 2021/0246710 A1 Aug. 12, 2021

(30) Foreign Application Priority Data

Feb. 7, 2020 (TW) ..... 109201395

(51) Int. Cl.

| | |
|---|---|
| ***E06B 1/52*** | (2006.01) |
| ***E06B 1/34*** | (2006.01) |
| ***E06B 3/02*** | (2006.01) |
| ***E06B 3/964*** | (2006.01) |

(52) U.S. Cl.

CPC ..... *E06B 1/52* (2013.01); *E06B 1/34* (2013.01); *E06B 3/02* (2013.01); *E06B 3/9644* (2013.01)

(58) Field of Classification Search

CPC ..... E06B 1/34; E06B 1/52; E06B 3/02; E06B 3/9644

USPC ..... 52/211

See application file for complete search history.

(56) References Cited

U.S. PATENT DOCUMENTS 2,777,173 A * 1/1957 Caswall ..... E06B 3/02 52/800.14
2,788,097 A * 4/1957 Frick ..... E05D 15/0665 52/207
3,403,476 A * 10/1968 Ciucani ..... E06B 3/16 49/401
6,141,925 A * 11/2000 Halvorson, Jr. ..... E04B 2/7455 52/126.3
6,405,506 B2 * 6/2002 Ruff ..... E06B 1/12 49/504
6,745,523 B2 * 6/2004 Petta ..... E06B 1/34 52/213
7,117,639 B2 * 10/2006 Abdella ..... E05B 9/08 49/382
7,661,226 B2 * 2/2010 Kibbel ..... E06B 1/526 49/382
8,584,426 B2 * 11/2013 Valier ..... E06B 3/549 52/656.5
8,857,105 B2 * 10/2014 Hemping ..... E06B 3/36 49/396

(Continued)

*Primary Examiner* — Brian E Glessner
*Assistant Examiner* — James J Buckle, Jr.
(74) *Attorney, Agent, or Firm* — Muncy, Geissler, Olds & Lowe, P.C.

(57) ABSTRACT

A modular glass door assembly includes a door, an inner frame, and an outer frame. The door has a glass door leaf and a doorframe mounted to the outer periphery of the glass door leaf. The inner frame is attached to the outer periphery of the doorframe and connected to the doorframe by two hinges up and down. The outer frame has four frame strips arranged around the outer periphery of the inner frame and each provided with a concave portion engaged with one respective convex portion of the inner frame. By this way, the inner frame and the outer frame can be directly assembled with each other or a fixed window panel can be added between the inner frame and the outer frame. Thus, the modular glass door assembly of the present invention has advantages of easy assembly and high scalability.

7 Claims, 8 Drawing Sheets

(56) References Cited

U.S. PATENT DOCUMENTS 9,382,751 B2 * 7/2016 Hemping ..... E05D 15/00
10,094,164 B2 * 10/2018 Massey ..... E06B 3/9632
10,526,835 B2 * 1/2020 Hemping ..... E06B 7/18
10,655,382 B2 * 5/2020 Braun ..... E06B 3/5892
10,851,572 B1 * 12/2020 Flynn ..... E05D 15/565
D910,206 S * 2/2021 Nakata ..... D25/16
11,035,169 B1 * 6/2021 Wermers ..... E06B 1/6015
2006/0070318 A1 * 4/2006 Chen ..... E06B 3/5454
52/204.65
2006/0150524 A1 * 7/2006 Kibbel ..... E06B 1/526
49/501
2008/0271394 A1 * 11/2008 Hand ..... E06B 1/02
52/210
2012/0047809 A1 * 3/2012 Hemping ..... E06B 7/2316
49/394
2014/0053479 A1 * 2/2014 Valier ..... E06B 3/549
52/204.5
2014/0102017 A1 * 4/2014 Booi ..... E06B 1/52
52/204.1
2014/0102018 A1 * 4/2014 Rochman ..... E06B 1/30
52/210
2015/0027061 A1 * 1/2015 Hemping ..... E05B 1/003
49/506
2015/0361718 A1 * 12/2015 Hummel ..... E06B 9/52
160/189
2016/0298374 A1 * 10/2016 Hemping ..... E06B 7/2312
2017/0218681 A1 * 8/2017 Siddiqui ..... E06B 1/52
2017/0218687 A1 * 8/2017 Hemping ..... E06B 7/26
2018/0313137 A1 * 11/2018 Plummer ..... E06B 3/5481
2020/0018060 A1 * 1/2020 Watanabe ..... E04H 1/125
2021/0207429 A1 * 7/2021 Kim ..... E06B 1/52
2021/0209878 A1 * 7/2021 Kim ..... F25D 13/00

* cited by examiner

MODULAR GLASS DOOR ASSEMBLY

BACKGROUND OF THE INVENTION

1. Field of the Invention

The present invention relates to doors and more particularly, to a modular glass door assembly, which is convenient to be assembled and has good scalability.

2. Description of the Related Art

A conventional door is pivotally connected with a doorframe by using two hinges up and down so as to be moved relative to the doorframe between the open and closed positions. However, the conventional door is inconvenient to be assembled with the doorframe and lacks flexibility in use. Therefore, the configuration design of the conventional door still needs improvement.

SUMMARY OF THE INVENTION

It is a primary objective of the present invention to provide a modular glass door assembly, which is convenient to be assemble and has good scalability.

To attain the above objective, the modular glass door assembly of the present invention comprises a door, an inner frame, and an outer frame. The door has a glass door leaf and a doorframe mounted to the outer periphery of the glass door leaf. The inner frame is attached to the outer periphery of the doorframe and hinged to one side of the doorframe. Further, the inner frame has four convex portions arranged around the outer periphery thereof and located at the top, bottom, right, and left sides of the door. The outer frame has four frame strips attached to the outer periphery of the inner frame and located at the top, bottom, right, and left sides of the door. Further, the frame strips each have a concave portion engaged with one respective convex portion of the inner frame.

Through the above-described configuration design, the modular glass door assembly of the present invention can be assembled quickly by the engagement between the inner frame and the outer frame for achieving the effect of convenient assembly, and furthermore, a fixed window or the like can be added between the inner frame and the outer frame for achieving the effect of high scalability.

Preferably, the frame strips each have a flange at a front surface thereof and a wing portion at an outer surface thereof provided with a plurality of counterbored holes spaced from each other and a rib groove adjacent to the counterbored holes. Further, the outer frame further includes four covers concealing the counterbored holes of the frame strips and having one ends abutted against the flanges of the frame strips and the other ends with ribs detachably engaged with the rib grooves of the frame strips. By this way, the counterbored holes will not be exposed to the outside to maintain the structural integrity of the overall structure.

Preferably, the rib of each cover has a positioning hole at two ends thereof respectively. The outer frame further includes four adapters each having a positioning post at two ends thereof respectively. The two positioning posts of each adapter are detachably inserted into the positioning holes of the two adjacent covers. By this way, the outer frame has smooth appearance.

Preferably, the frame strips each have a slot at two ends thereof respectively. The adapters each have a plugging portion at two ends thereof respectively. The two plugging portions of each adapter are detachably inserted into the slots of two adjacent frame strips. By this way, the structural stability of the covers and the frame strips can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
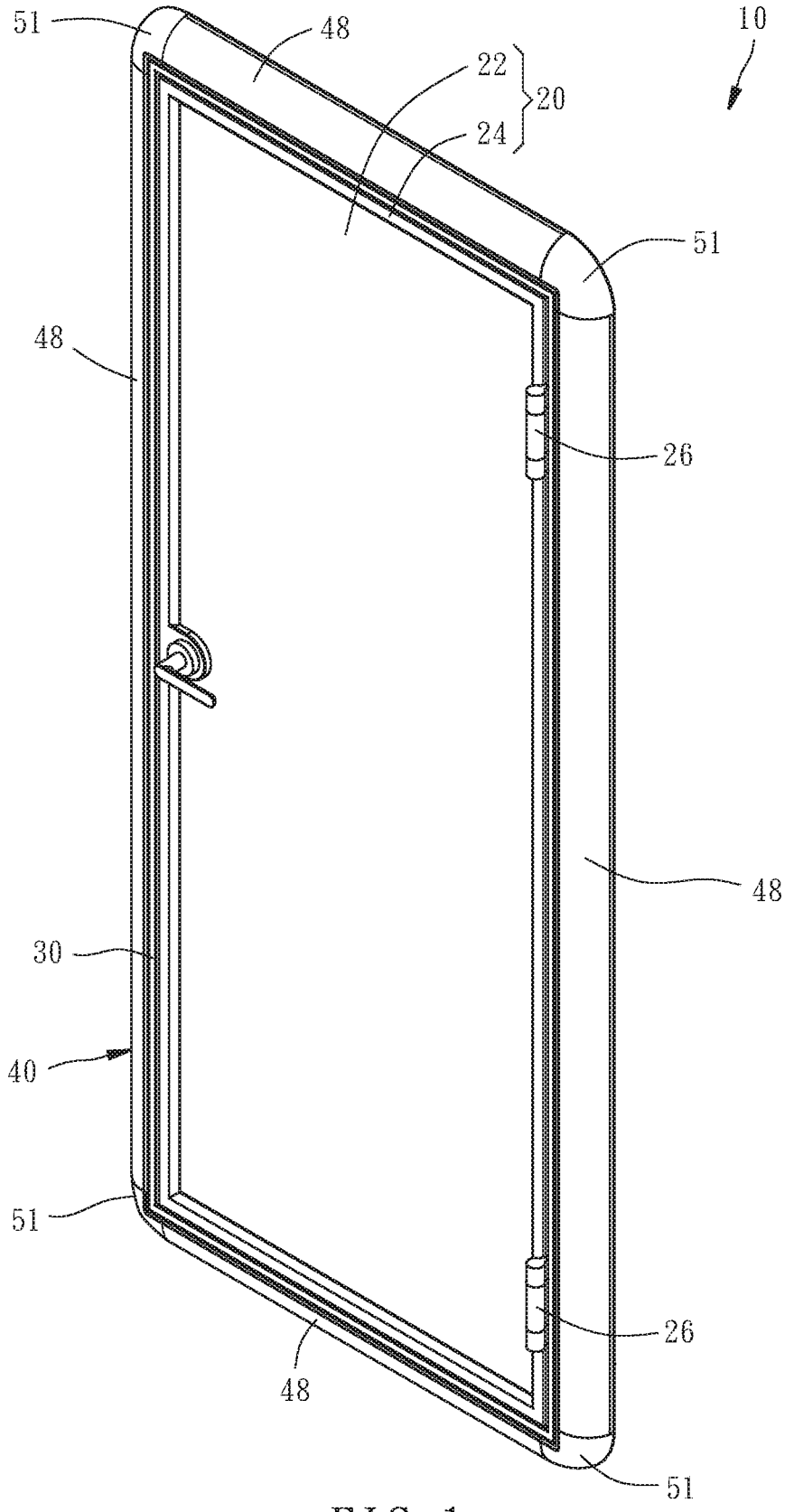
FIG. 1 is a perspective view of a modular glass door assembly of a first embodiment.

First of all, it is to be mentioned that throughout the specification, including the embodiments described below and the claims, the nouns relating to directionality are based on the directions in the figures. Besides, same reference numerals used in the following preferred embodiments and the appendix drawings designate same or similar elements or the structural features thereof.

Figure 2:
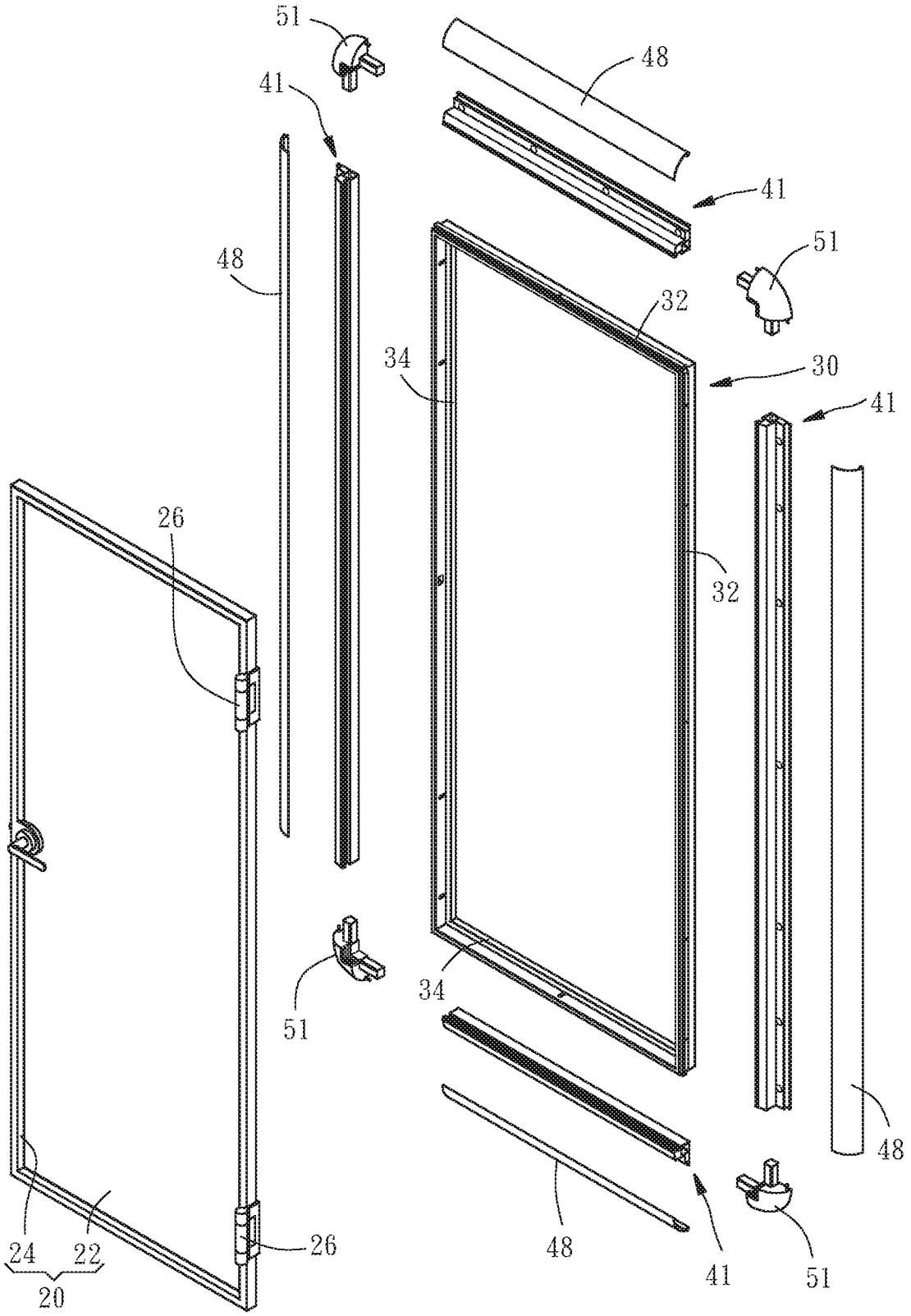
FIG. 2 is an exploded view of the modular glass door assembly of the first embodiment.

Referring to FIGS. 1 and 2, the modular glass door assembly 10 of the first embodiment comprises a door 20, an inner frame 30, and an outer frame 40.

The door 20 has a glass door leaf 22 and a doorframe 24 fixedly mounted to the outer periphery of the glass door leaf 22.

Figure 3:
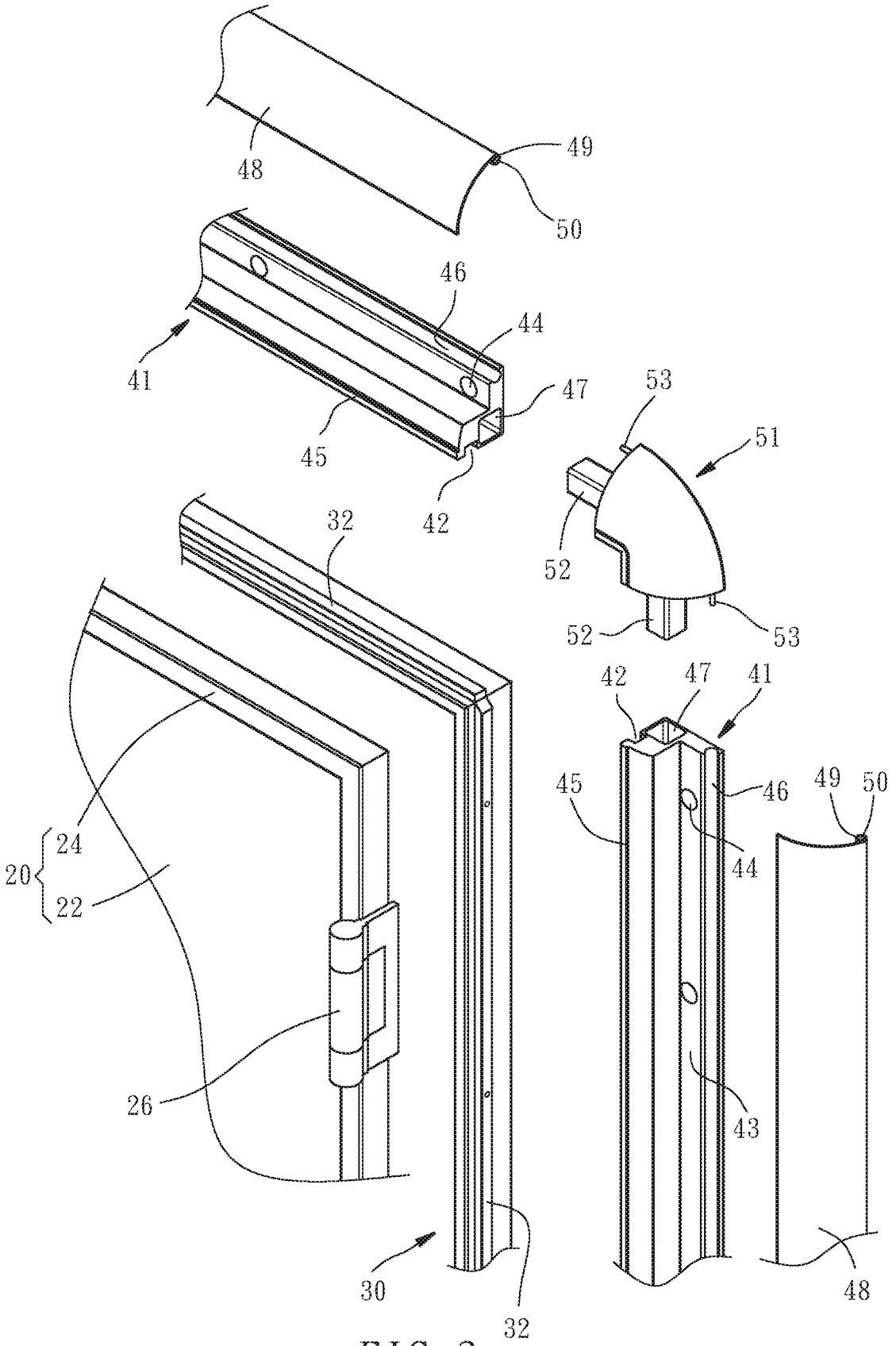
FIG. 3 is an enlarged view of FIG. 2.

The inner frame 30 is rectangular and hinged to the right side of the doorframe 24 by using two hinges 26 up and down, such that the door 20 can be moved relative to the inner frame 30 between the open and closed positions. As shown in FIGS. 2 and 3, the inner frame 30 has four convex portions 32 and four bearing portions 34. The convex portions 32 are arranged around the outer periphery of the inner frame 30 and located at the top, bottom, left, and right sides of the door 20. The bearing portions 34 are arranged around the inner periphery of the inner frame 30 and located at the top, bottom, left, and right sides of the door 20. After the door 20 is closed, the doorframe 24 is abutted against the bearing portions 34 of the inner frame 30 so as to keep the door 20 in the closed position.

Figure 4:
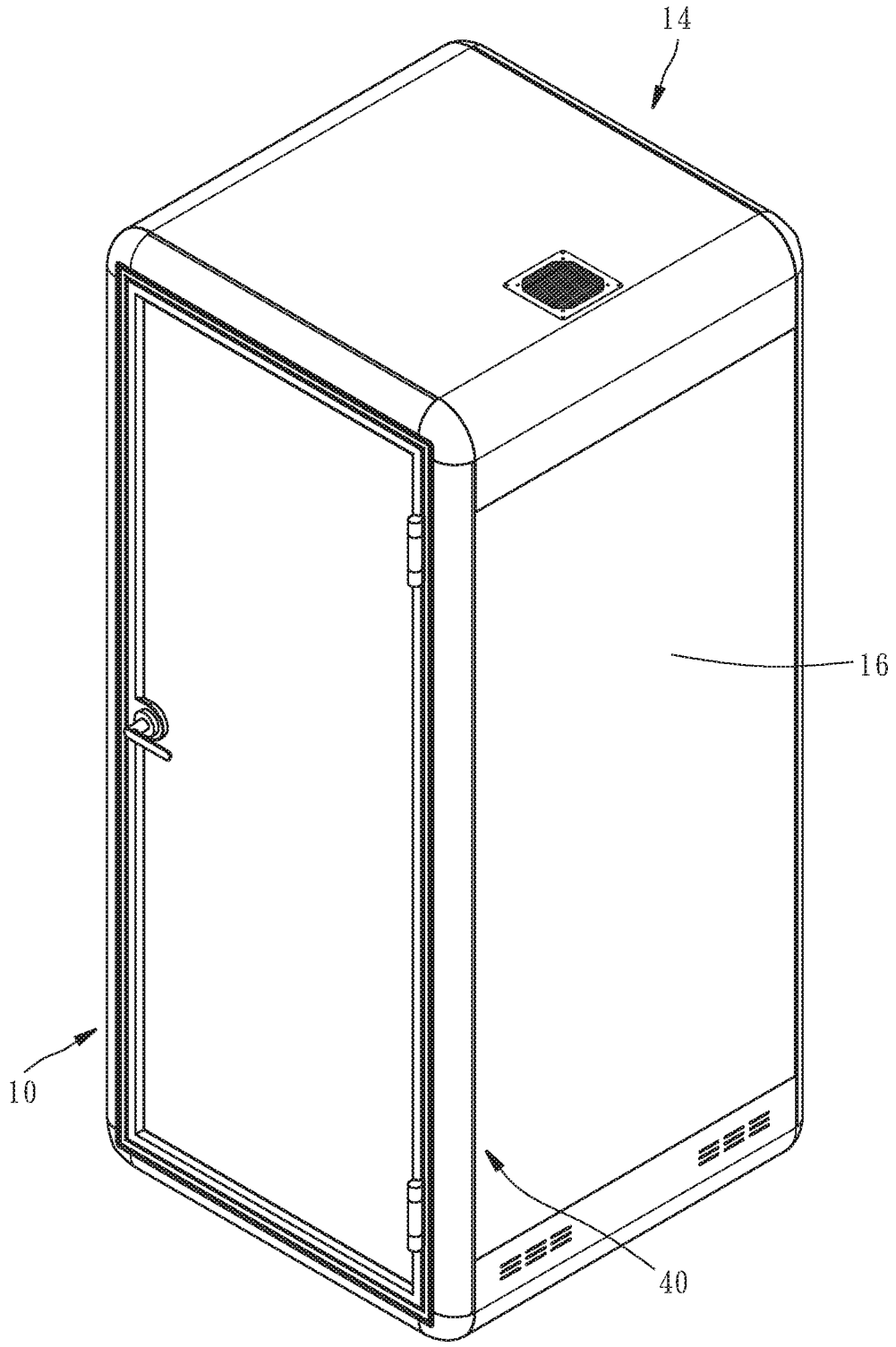
FIG. 4 is a perspective view of a building using the modular glass door assembly of the first embodiment.
Figure 5:
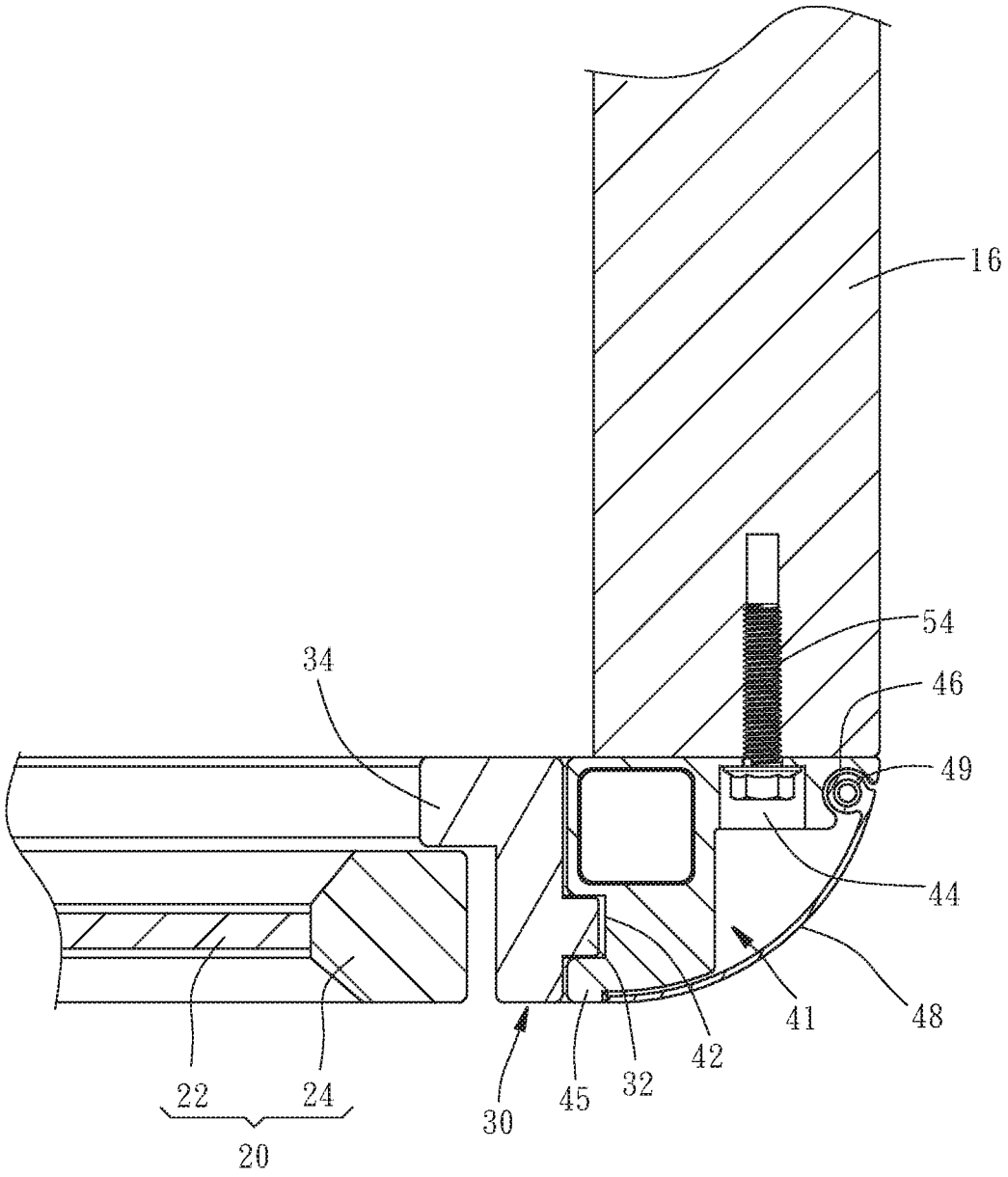
FIG. 5 is a partial sectional view of FIG. 4.

The outer frame 40 includes four frame strips 41 arranged around the outer periphery of the inner frame 30 and located at the top, bottom, left and right sides of the door 20. The upper and lower frame strips 41 have relative shorter length, and the left and right frame strips 41 have relative longer length. The frame strips 41 each have a concave portion 42 at the inner surface thereof. In this embodiment, as shown in FIGS. 2, 3 and 5, the concave portions 42 of the frame strips 41 of the outer frame 40 are engaged with the convex portions 32 of the inner frame 30 in a one-to-one manner. Further, the frame strips 41 each have a wing portion 43 at the outer surface thereof provided with a plurality of counterbored holes 44 spaced from each other. Each of the frame strips 41 can be fixed to a lateral wall 14 of a building 12 as shown in FIG. 4 by a bolt 54 received in one respective counterbored hole 44.

As shown in FIGS. 3 and 5, the frame strips 41 each have a flange 45 at the front surface thereof, and the frame strips 41 each have a rib groove 46 at the outer surface thereof adjacent to the counterbored holes 44. The outer frame 40 further includes four covers 48 having one ends abutted against the flanges 45 of the frame strips 41 in a one-to-one manner and the other ends provided with ribs 49 detachably engaged with the rib grooves 46 of the frame strips 41 in a one-to-one manner, such that the counterbored holes 44 and the bolts 54 received in the counterbored holes 44 are sheltered by the covers 48 after the assembly of the covers 48 is completed.

As shown in FIGS. 3 and 5, the frame strips 41 each have a square slot 47 at two ends thereof respectively, and the ribs 49 of the covers 48 each have a positioning hole 50 at two ends thereof respectively. The outer frame 40 further includes four adapters 51 each having a square plugging portion 52 and a cylindrical positioning post 53 at two ends thereof respectively. The plugging portions 52 of each adapter 51 are inserted into the slots 47 of the two adjacent frame strips 41 for providing a smooth appearance to the outer frame 40, and the positioning posts 53 of each adapter 51 are inserted into the positioning holes 50 of the two adjacent covers 48 for enhancing structural stability of the covers 48 and the frame strips 41.

Figure 6:
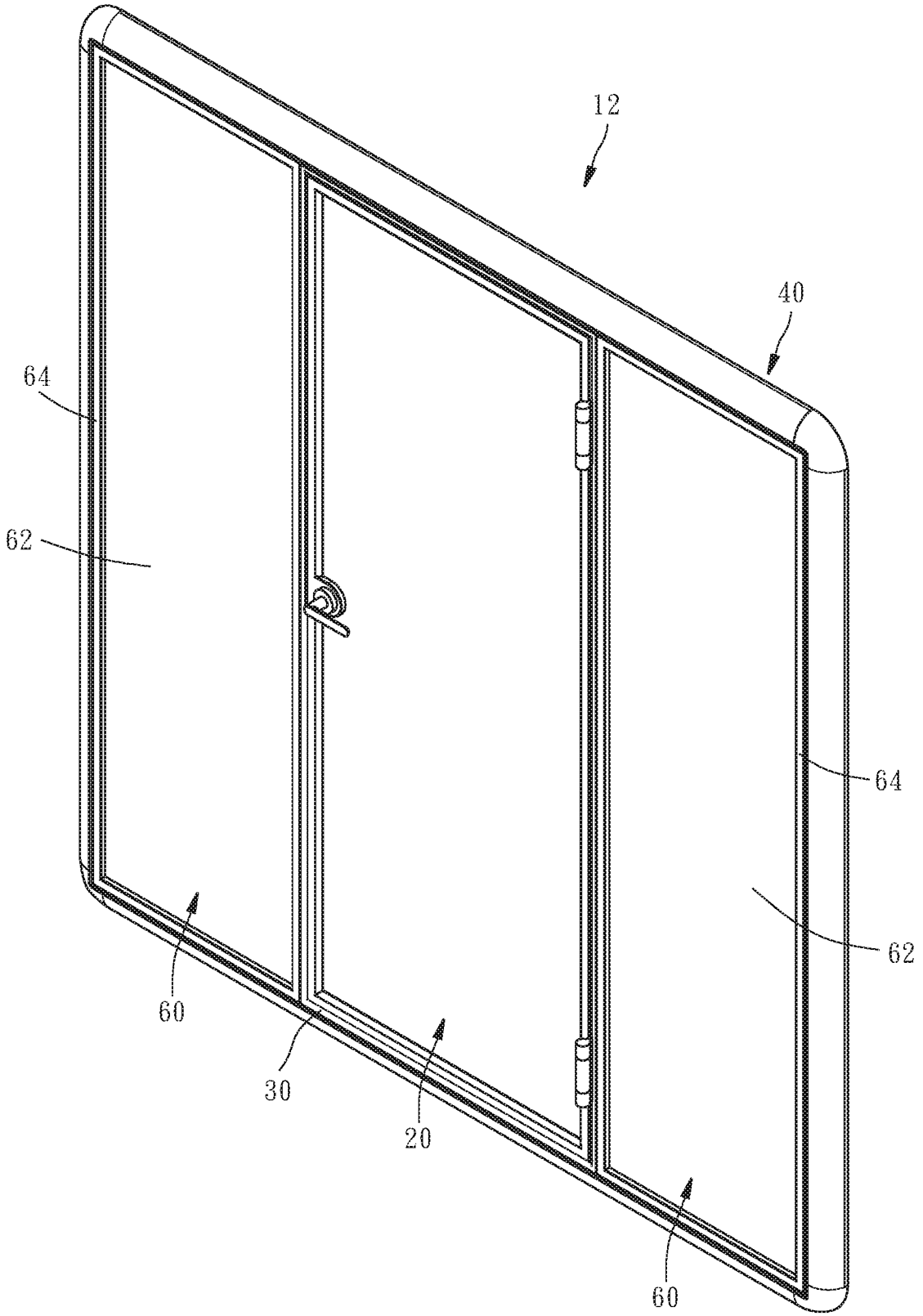
FIG. 6 is a perspective view of the modular glass door assembly of a second embodiment.
Figure 7:
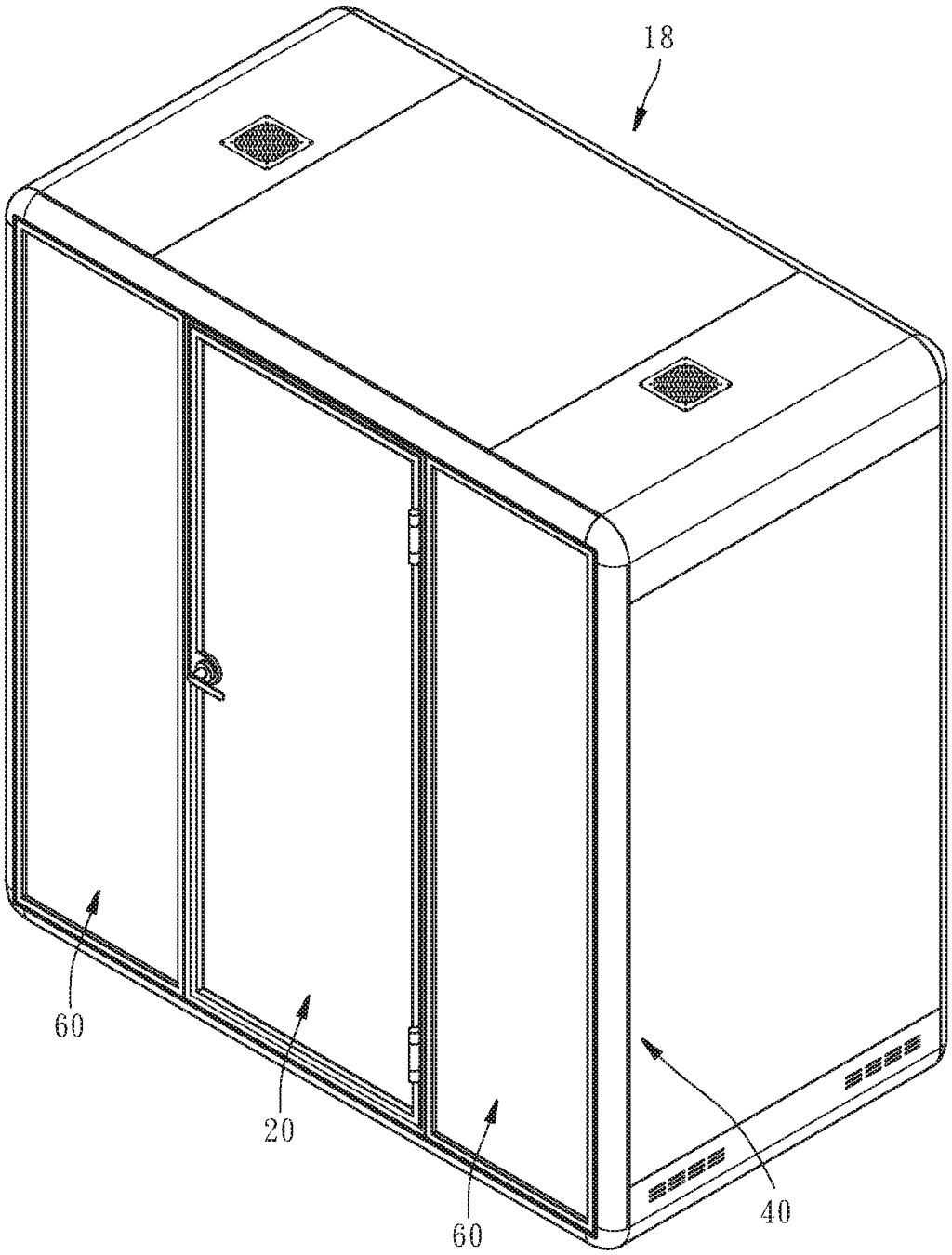
FIG. 7 is a perspective view of a building using the modular glass door assembly of the second embodiment.
Figure 8:
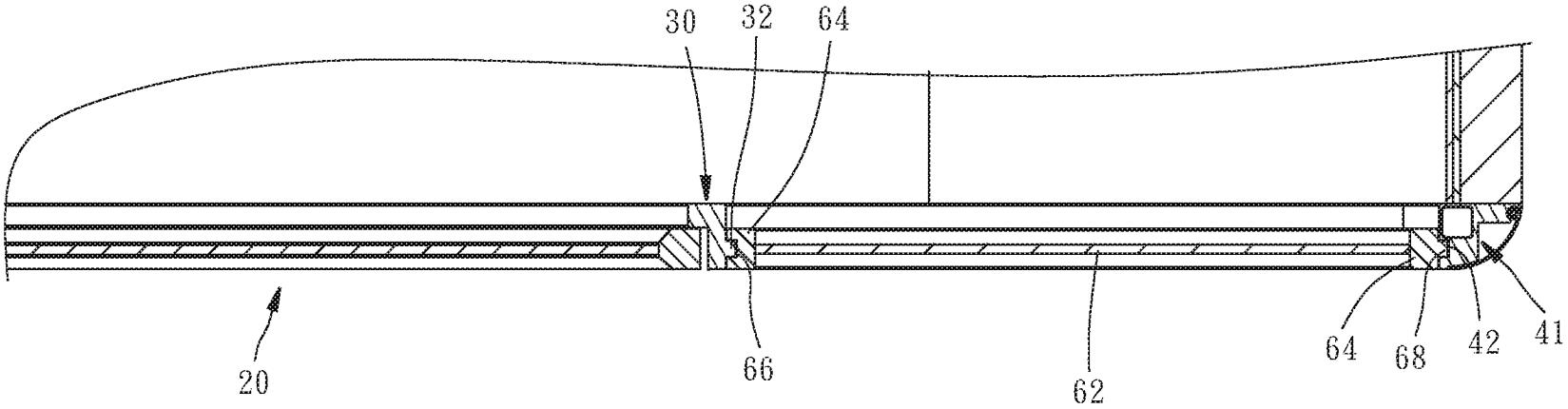
FIG. 8 is a partial sectional view of FIG. 7.

As shown in FIGS. 6 to 8, in the second embodiment, the convex portions 32 of the inner frame 30 and the concave portions 42 of the outer frame 40 aren't directly engaged with each other. At least one fixed window 60 is provided between the inner frame 30 and the outer frame 40, comprising a glass window panel 62 and a window frame 64 mounted to the outer periphery of the glass window panel 62. The window frame 64 has a concave portion 66 and three convex portions 68 at the surface thereof. The concave portion 66 and one of the convex portions 68 are located at two long sides of the window frame 64. Another two of the convex portions 68 are located at two short sides of the window frame 64. By this way, the concave portion 66 of the window frame 64 is engaged with one of the convex portions 32 of the inner frame 30, and the three convex portions 68 of the window frame 64 are engaged with the concave portions 42 of the three frame strips 41 of the outer frame 40, such that the two fixed windows 60 can be assembled with the left and right sides of the door 20 for achieving the effect of high scalability.

As described above, the modular glass door assembly 10 of the present invention can be assembled quickly through the engagement between the inner frame 30 and the outer frame 40. Further, the fixed window 60 or the like can be added between the inner frame 30 and the outer frame 40 according to the actual needs for achieving the effect of high scalability, thereby providing excellent flexibility to the overall structure.

What is claimed is:

1. A modular glass door assembly comprising:

a door having a glass door leaf and a doorframe mounted to an outer periphery of the glass door leaf;

an inner frame attached to an outer periphery of the doorframe and hinged to one side of the doorframe, the inner frame having four convex portions arranged around an outer periphery of the inner frame and located at top, bottom, right, and left sides of the door; and an outer frame having four frame strips attached to an outer periphery of the inner frame and located at top, bottom, right, and left sides of the door, the frame strips each have a concave portion engaged with one respective convex portion of the inner frame;

wherein the frame strips each have a flange at a front surface thereof and a wing portion at an outer surface thereof provided with a plurality of counterbored holes spaced from each other and a rib groove adjacent to the counterbored holes; the outer frame further comprises four covers concealing the counterbored holes of the frame strips and having one ends abutted against the flanges of the frame strips and the other ends with ribs detachably engaged with the rib grooves of the frame strips.

2. The modular glass door assembly as claimed in claim 1, wherein the frame strips each have a slot at two ends thereof respectively; the outer frame further comprises four adapters each having a plugging portion at two ends thereof respectively; the two plugging portions of each adapter are detachably inserted into the slots of the two adjacent frame strips.

3. The modular glass door assembly as claimed in claim 1, wherein the rib of each cover has a positioning hole at two ends thereof respectively; the outer frame further comprises four adapters each having a positioning post at two ends thereof respectively; the two positioning posts of each adapter are detachably inserted into the positioning holes of the two adjacent covers.

4. The modular glass door assembly as claimed in claim 3, wherein the frame strips each have a slot at two ends thereof respectively; the adapters each have a plugging portion at two ends thereof respectively; the two plugging portions of each adapter are detachably inserted into the slots of the two adjacent frame strips.

5. The modular glass door assembly as claimed in claim 1, wherein the inner frame further comprises four bearing portions arranged around an inner periphery of the inner frame and abutted against the doorframe.

6. The modular glass door assembly as claimed in claim 1, wherein the concave portions of the frame strips of the outer frame are engaged with the convex portions of the inner frame in a one-to-one manner.

7. The modular glass door assembly as claimed in claim 1, further comprising two fixed windows located at two opposite sides of the door and each having a glass window panel and a window frame mounted to an outer periphery of the glass window panel and provided with a concave portion and three convex portions at an outer periphery thereof;

the concave portion of the window frame is detachably engaged with one of the convex portions of the inner frame, and the three convex portions of the window frame are detachably engaged with the concave portions of three of the frame strips of the outer frame.

* * * * *